US010607757B1

(12) United States Patent
Sakurai et al.

(10) Patent No.: US 10,607,757 B1
(45) Date of Patent: Mar. 31, 2020

(54) PRODUCTION METHOD OF SOFT MAGNETIC METAL POWDER

(71) Applicant: TDK CORPORATION, Tokyo (JP)

(72) Inventors: Yu Sakurai, Tokyo (JP); Tomofumi Kuroda, Tokyo (JP); Hideyuki Itoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 201 days.

(21) Appl. No.: 15/639,001

(22) Filed: Jun. 30, 2017

(51) Int. Cl.

| | |
|---|---|
| ***H01F 1/22*** | (2006.01) |
| ***H01F 41/02*** | (2006.01) |
| ***B22F 1/00*** | (2006.01) |
| ***C23C 8/24*** | (2006.01) |

(52) U.S. Cl.
CPC ..... *H01F 1/22* (2013.01); *B22F 1/0048* (2013.01); *B22F 1/0085* (2013.01); *H01F 41/0246* (2013.01); *C23C 8/24* (2013.01)

(58) Field of Classification Search
None
See application file for complete search history.

(56) References Cited

U.S. PATENT DOCUMENTS

| | | | | |
|---|---|---|---|---|
| 5,800,636 | A | 9/1998 | Tsukada et al. | |
| 9,779,861 | B2 * | 10/2017 | Sakurai | H01F 1/1475 |
| 2009/0121175 | A1 * | 5/2009 | Maeda | B22F 1/0062 252/62.51 R |
| 2012/0048063 | A1 * | 3/2012 | Maetani | C22C 33/0271 75/246 |

(Continued)

FOREIGN PATENT DOCUMENTS

| | | | |
|---|---|---|---|
| JP | H02-57608 | A | 2/1990 |
| JP | H09-260126 | A | 10/1997 |
| JP | 2000-294418 | A | 10/2000 |

(Continued)

OTHER PUBLICATIONS

Kimihiro Akata et al, Google Translate JP 2011114321, Soft Magnetic Particle, Published 2011 (Year: 2011).*

(Continued)

*Primary Examiner* — Colleen P Dunn
*Assistant Examiner* — Michael J Kachmark
(74) *Attorney, Agent, or Firm* — Oliff PLC

(57) ABSTRACT

The present invention is a method of producing a soft magnetic metal powder comprising, a material powder preparation step of preparing a material powder comprising a particle including a boron and a soft magnetic metal including an iron, a first nitriding step of nitriding the boron included in said particle by carrying out a heat treatment to said material powder under a non-oxidizing atmosphere including nitrogen, and a spheroidizing step of spheroidizing said particle by carrying out a heat treatment to said material powder of after said first nitriding step under a non-oxidizing atmosphere having lower nitrogen partial pressure than a nitrogen partial pressure of the non-oxidizing atmosphere during said first nitriding step. According to the present invention, the soft magnetic metal powder comprising the particle having a shape of a complete sphere or close to complete sphere, and comprising the small standard deviation of the particle size distribution of the powder can be obtained.

12 Claims, 15 Drawing Sheets

(56) References Cited

U.S. PATENT DOCUMENTS

2015/0332821 A1* 11/2015 Sakurai ..... H01F 1/1475
252/62.55
2016/0303652 A1* 10/2016 Takashita ..... C22C 38/00

FOREIGN PATENT DOCUMENTS

JP 2002-057020 A 2/2002
JP 2011-114321 A 6/2011

OTHER PUBLICATIONS

Kimihiro Akata et al, Machine Translation JP 2011114321, Soft Magnetic Particle, Published 2011 (Year: 2011).*
Takamasa Ishigaki, Spheroidization of Titanium Carbide Powders by Induction Thermal Plasma Processing, Journal of American Ceramic Society, Published 2001 (Year: 2001).*
Rodrigo Garza, Spheroidization of Iron Powders by Radiative Heat Transfer, Massachusetts Institute of Technology, Published Jun. 1999 (Year: 1999).*
Kimihiro Akata et al, Partial USPTO Translation JP 2011114321, Soft Magnetic Particle, Published 2011 (Year: 2011).*

* cited by examiner

PRODUCTION METHOD OF SOFT MAGNETIC METAL POWDER

FIELD OF THE INVENTION

The present invention relates to a production method of a soft magnetic metal powder, and particularly relates to the production method of the soft magnetic metal powder suitably used as a core of an electromagnetic circuit member such as inductor and reactor or so.

DESCRIPTION OF THE RELATED ART

As a magnetic core material for the reactor and inductor used when applying large electric current, a ferrite core and a dust core constituted from soft magnetic powder, and a stacked electromagnetic steel plate using a silicon steel or so may be mentioned.

The stacked electromagnetic steel plate has a high saturation magnetic flux density, but when the driving frequency of the power circuit exceeds several tens kHz, then the loss increases, and the efficiency declines. Also, it was difficult to apply to a compact product having complicated shape.

The ferrite core is a magnetic core material having small core loss at a high frequency, but since the saturation magnetic flux density is low, in order to attain the same performance, the shape of the core was enlarged.

The dust core constituted from the soft magnetic metal powder has smaller core loss than the stacked electromagnetic steel plate, and has larger saturation magnetic flux density than the ferrite core; hence it is widely used as the magnetic core material. However, when the relative density of the dust core is low, a maximum magnetic characteristic of the soft magnetic metal powder couldn't be exhibited.

As the means to increase the relative density of the dust core, a particle constituting the soft magnetic powder used for the dust core is blended by regulating its shape, or regulating the particle size of the powder or so may be mentioned as an example. As the method of regulating the shape of the particle, for example JP Patent Application Laid Open No. 2011-114321 discloses that the apparent density can be improved by making the shape of the particle to a true sphere or extremely close to a true sphere.

Also, JP Patent Application Laid Open No. H02-57608 discloses to spheroidize the particle shape of the atomized powder by comprising small amount of boron (B) and phosphor (P) in the soft magnetic metal.

Also, as the blending wherein the particle size of the powder has been regulated, the relative density of the dust core can be increased by blending two types or more of the powders having different average particle diameter. For example, JP Patent Application Laid Open No. 2000-294418 discloses to blend three types of powders wherein the most frequent value of the particle size distribution differing by five times or more respectively.

As mentioned in above, the high frequency core loss of the dust core constituted by the soft magnetic metal powder is smaller than the stacked electromagnetic steel plate, but it is not as small as the low loss as in the ferrite or so, hence further reduction of the high frequency core loss is in demand.

As the method for reducing the high frequency core loss of the dust core constituted by the soft magnetic metal powder, the method of reducing the coercivity of the soft magnetic metal powder is known. For example, JP Patent Application Laid Open No. H09-260126 discloses that by heat treating the iron powder at high temperature, a distortion can be removed and the crystal particle diameter can be increased, thereby the coercivity of the iron powder can be reduced. Similarly, JP Patent Application Laid Open No. 2002-57020 discloses that by heat treating the soft magnetic metal powder at high temperature, the distortion of the powder can be removed, and the coercivity of the soft magnetic metal powder can be reduced.

SUMMARY OF THE INVENTION

Object to be Solved by the Invention

As the production method of the soft magnetic metal powder, a water atomization method, and a gas atomization method or so are known. A water atomized powder produced by the water atomization method is low cost, but the particle is obtained by rapidly cooling and solidifying a drop of molten metal, thus the shape is an irregular shape, thus it is difficult to obtain a particle having a true sphere.

On the other hand, the gas atomized powder produced by the gas atomization method costs more than the water atomization method, but the particle is obtained by cooling the molten metal relatively slowly and solidifying thus the particle having a shape close to the true sphere can be obtained.

However, for either method of the water atomization method and the gas atomization method, the particle size distribution of the produced powder is wide, thus it is not suited as the powder used for the blending wherein the particle size of the powder is regulated. Note that, by classifying the powder produced by the atomization method, the powder having narrow particle size distribution can be obtained, but the cost for the classification is generated and also the waste loss of the powder due to the classification is generated, thus it is not realistic.

Therefore, the soft magnetic metal powder wherein the shape of the particle is a true sphere or close to a true sphere, and also having a narrow particle size distribution was very difficult to attain.

Also, in order to reduce the coercivity of the soft magnetic metal powder, the magnetic domain wall movement must be easy. The soft magnetic metal powder produced by the water atomization method includes a pore and a impurity phase such as oxides or so which are taken inside of the particle. These interferes the magnetic domain wall movement and increase the coercivity. Also, magnetic wall movement is influenced by the condition of the particle surface.

Therefore, in order to reduce the coercivity, the pore and a impurity phase which are taken inside of the particle are preferably reduced. Also, in order to reduce the influence from the particle surface, the specific surface area of the particle is made small, that is the particle having high spheroidicity is preferable.

However, the technology disclosed in JP Patent Application Laid Open No. H09-260126 and JP Patent Application Laid Open No. 2002-57020 are not sufficient in regards with the removal of the distortion and the increase of the crystal particle diameter, and these have not considered the pore and the impurity phase taken inside the particle and the influence from the particle surface.

According to the technology disclosed in JP Patent Application Laid Open No. H02-57608, the particle shape is improved to some degree, but the pore and the impurity phase taken inside the particle cannot be removed, and the particle surface is not sufficiently smoothed. Also, the addition of the boron and phosphor will increase the coercivity, thus if the content of the boron and phosphor are increased, the coercivity will increase.

As discussed in above, the technology disclosed in above articles failed to sufficiently reduce the coercivity of the obtained soft magnetic metal powder.

The present invention was attained in view of such circumstances, and the object is to provide the production method of the soft magnetic metal powder wherein the shape of the particle is a true sphere or close to a true sphere, and also the powder has a narrow particle size distribution.

In order to attain the above object, the method of producing the soft magnetic metal powder according to the present invention comprises a material powder preparation step of preparing a material powder comprising a particle including a boron and a soft magnetic metal including an iron, a first nitriding step of nitriding the boron included in said particle by carrying out a heat treatment to said material powder under a non-oxidizing atmosphere including nitrogen, and a spheroidizing step of spheroidizing said particle by carrying out a heat treatment to said material powder of after said first nitriding step under a non-oxidizing atmosphere having lower nitrogen partial pressure than a nitrogen partial pressure of the non-oxidizing atmosphere during said first nitriding step.

The method of producing the soft magnetic metal powder according to the present invention preferably comprises a second nitriding step of nitriding the boron included in a spheroidized particle by carrying out the heat treatment to the material powder comprising said spheroidized particle under a non-oxidizing atmosphere having higher nitrogen partial pressure than the nitrogen partial pressure of the non-oxidizing atmosphere during the spheroidizing step.

The method of producing the soft magnetic metal powder according to the present invention preferably comprises a boron nitride removal step of removing a part of boron nitride included in the spheroidized particle.

The method of producing the soft magnetic metal powder according to the present invention preferably forms a coating part including boron nitride at a surface of said particle during said first nitriding step. Also, preferably a coating part including a boron nitride at a surface of said spheroidized particle is formed during said second nitriding step.

The method of producing the soft magnetic metal powder according to the present invention preferably has a content of said boron included in the material powder of 0.4 mass % or more and 2.0 mass % or less during the material powder preparation step.

The method of producing the soft magnetic metal powder according to the present invention preferably has the soft magnetic metal including the iron which is crystalline.

Effect of the Invention

According to the present invention, the method of producing the soft magnetic metal powder wherein the shape of the particle is a true sphere or close to a true sphere, and the powder having a narrow particle size distribution can be provided.

DESCRIPTION OF THE PREFERRED EMBODIMENTS

Hereinafter, the present invention will be described in detail in the order listed in below based on the embodiment shown in the figures.

Figure 1:
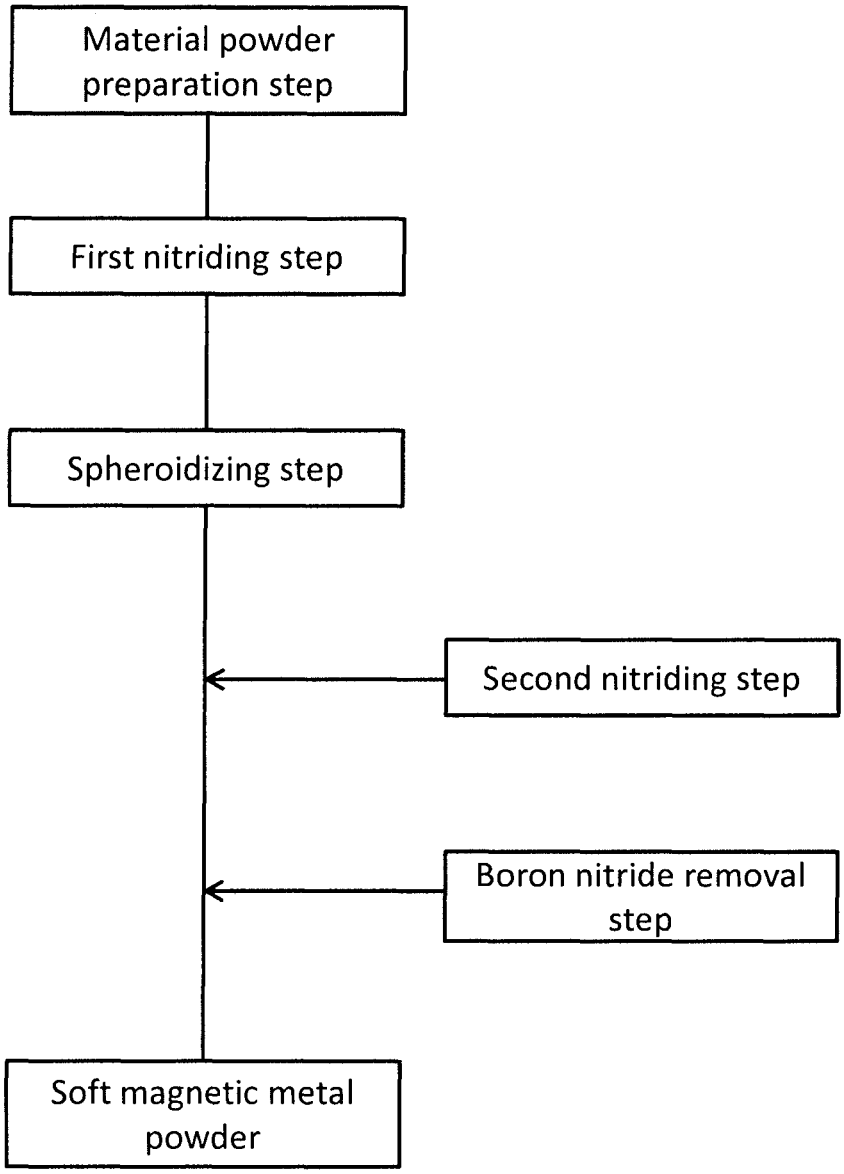
FIG. 1 is the figure showing the steps of the method of production according to the present invention.

1. Production method of the soft magnetic metal powder
   - 1.1 Material powder preparation step
   - 1.2 First nitriding step
   - 1.3 Spheroidizing step
   - 1.4 Boron nitride removal step
   - 1.5 Second nitriding step
2. Soft magnetic metal powder
3. Modified example The production method of the soft magnetic metal powder according to the present embodiment is the method of carrying out the heat treatment to the material powder including the soft magnetic metal powder and boron (B) under the predetermined non-oxidizing atmosphere. Hereinafter, the method of producing the soft magnetic metal powder will be described in detail using the steps shown in FIG. 1.

(1.1 Material Powder Preparation Step)

First, the material powder is prepared. In the present embodiment, the material powder is composed of large number of particles including the soft magnetic metal phase as the main phase, and further including boron. The soft magnetic metal is crystalline including Fe, for example, pure Fe or an Fe based alloy may be suitable. As the Fe based alloy, Fe—Si alloy, Fe—Si—Cr alloy, Fe—Ni alloy, Fe—Co alloy or so may be suitable. In the present embodiment, the soft magnetic metal is preferably Fe—Si alloy, Fe—Si—Cr alloy and Fe—Ni alloy as these have high saturation magnetization, and small crystal magnetic anisotropy and magnetostriction constant.

Note that, the coercivity tends to increase when the above mentioned soft magnetic metal includes boron, thus it is not preferable to include boron in the soft magnetic metal powder. However, in the present invention, boron included in the material powder is used to bind and spheroidize the particle.

The content of boron included in the material powder is preferably 0.4 mass % or more, and more preferably 0.8 mass % or more. Also, the content of boron is preferably 2.0 mass % or less, more preferably 1.6 mass % or less, and even more preferably 1.2 mass % or less.

If the content of boron is too small, boron necessary for the spheroidization of the particle tends to be insufficient. On the other hand, if the content of boron is too much, the time for completing the spheroidization tends to take longer.

The average particle diameter of the material powder is not particularly limited, but it needs to be smaller than the average particle diameter of the soft magnetic metal powder produced by the method according to the present embodiment. This is because, as it will be described in below, in the present embodiment, the spheroidization is done by binding the particles which constitute the material powder with each other. Therefore, the shape of the particle constituting the material powder is not particularly limited, and it may be indeterminate shape.

The method of producing material powder is not particularly limited, and in the present embodiment, the water atomization method, the gas atomization method, and the pulverization of cast metals may be mentioned as examples, and the water atomization method is preferable.

Figure 2:
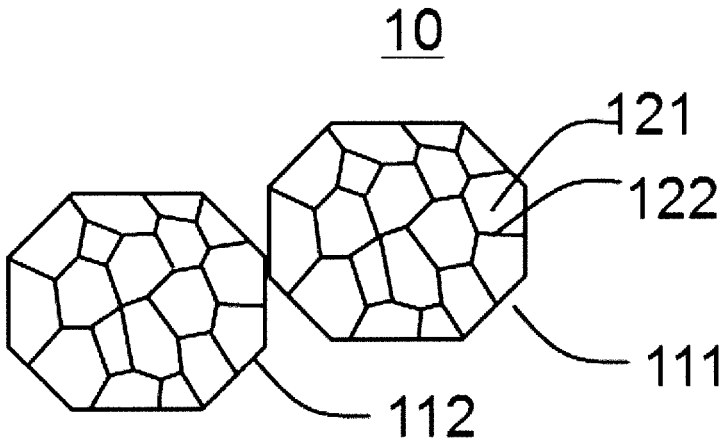
FIG. 2 is the schematic diagram of the particle constituting the material powder.

The schematic diagram of the cross section of the particle constituting the material powder is shown in FIG. 2. The cross section shape of the particle 111 and the particle 112 constituting the material powder 10 has an irregular (not spherical) shape; and the inside of the particle 111 and the particle 112 include many crystal grain 121 which are partitioned by many grain boundary 122. The crystal grain is constituted from the above mentioned soft magnetic metal. Boron is present inside the crystal grain 121, or at the grain boundary 122.

(1.2 First Nitriding Step)

In the first nitriding step, the material powder prepared is subjected to the heat treatment under the non-oxidizing atmosphere including nitrogen. Due to the heat treatment, a part of the boron included in the material powder reacts with the nitrogen in the atmosphere; thereby the coating part including boron nitride at the surface of the material powder is formed.

Figure 3:
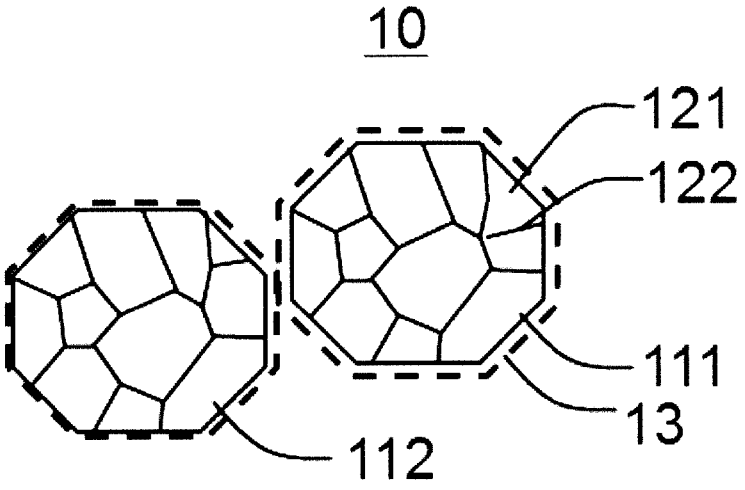
FIG. 3 is the schematic diagram of the cross section of the particle constituting the material powder after the first nitriding step.

As shown in FIG. 3, in the present embodiment, this coating part is a small flake or flakaes 13 of the boron nitride. This flake 13 may at least cover a part of the surface of the particle 111 and 112, but as shown in FIG. 3, it preferably covers the entire surface.

Also, the cross section of the particle 111 and particle 112 are irregular shape, and it is about the same as the cross section shape of the material powder shown in FIG. 2 which is before the first nitriding step. The crystal grain 121 constituting the inside of the particle 111 and the particle 112 will undergo the particle growth compare to before the nitriding step, and the number will decrease, but the particle 111 and the particle 112 still include many crystal grains 121. The rest of the boron exists inside of the crystal grain 121 or at the grain boundary 122.

In the first nitriding step, the nitrogen partial pressure in the atmosphere is preferably 0.1 atm (for example, 10% nitrogen concentration at the atmospheric pressure) or more, more preferably 0.5 atm (for example, 50% nitrogen concentration at the atmospheric pressure) or more, further preferably 0.9 atm (for example, 90% nitrogen concentration at the atmospheric pressure) or more, and even more preferably 1 atm (for example, 100% nitrogen concentration at the atmospheric pressure); that is nitrogen atmosphere is particularly preferable. Also, the oxygen partial pressure in the atmosphere is preferably 0.0001 atm (for example, 100 ppm of the oxygen concentration at the atmospheric pressure) or less. If the oxygen partial pressure is too high, the oxidizing reaction of the metal proceeds in parallel with the nitriding reaction, thus the shape of the coating part tends to be non-uniform.

In the first nitriding step, the heat treatment temperature is preferably 800° C. or more. Also, the heat treatment temperature is preferably 1350° C. or less, and more preferably 1100° C. or less.

If the heat treatment temperature is too low, the nitriding reaction of boron tends not to proceed. On the other hand, if the heat treatment temperature is too high, the time for completing the nitriding reaction does not change, but the control of the production amount of boron nitride tends to become difficult. Note that, at the high temperature such as 1000° C. or more, the particles of the material powder bind with each other and tend to easily sinter. However, in the present embodiment, the coating part including the boron nitride is rapidly formed at the surface of the particle, thus the particles do not sinter with each other. The boron nitride has high heat resistance, and has sintering resistance, thus the particles are interfered from sintering with each other.

As mentioned above, the flake of the boron nitride is preferably formed so that it is covering the entire surface of the particle surface. However, the spheroidizing step and the second nitriding step, which will be discussed in detail below, also use boron, and thus the amount of boron that is converted into boron nitride during the first nitriding step is preferably 30 to 70% of the boron amount in the material powder.

The produced amount of the boron nitride can be calculated from the amount of increase which is obtained by analyzing the nitrogen content of the powder after nitriding. However, in the present embodiment, the produced amount can be simply estimated from the change of the weight of the powder. The weight change during the formation of the boron nitride by the reaction between boron and nitride is +30% increase of the weight with respect to the weight of boron prior to the nitriding. Therefore, when the boron amount in the soft magnetic powder is "a" (mass %), the weight change of the soft magnetic metal powder in case all of the boron in the soft magnetic metal powder is nitride, has "+1.3×a". Further, if boron of "b" (%) among the boron in the soft magnetic metal powder reacts with nitrogen, the weight change of the soft magnetic metal powder is "+1.3×a×b/100".

(1.3 Spheroidizing step)

At the spheroidizing step, the material powder after the first nitriding step is heat treated under the non-oxidizing atmosphere. The nitrogen partial pressure in the atmosphere of the spheroidizing step is lower than the nitrogen partial pressure in the atmosphere of the first nitriding step.

Figure 4:
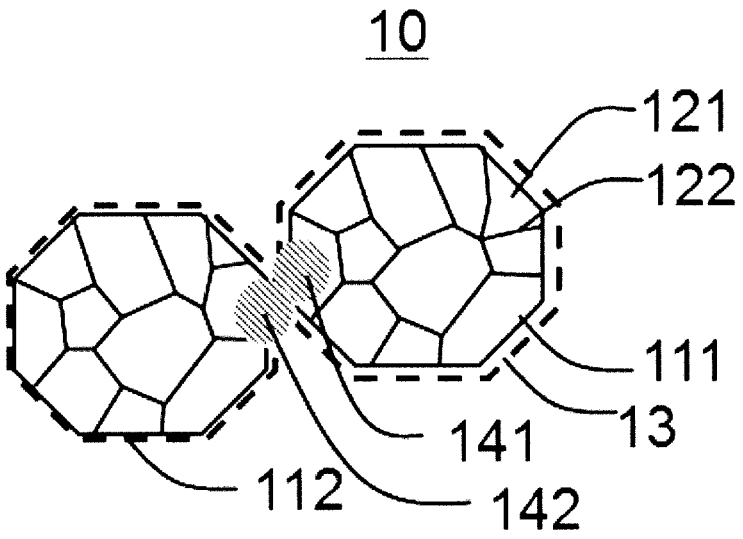
FIG. 4 is the schematic diagram describing that the particles bind against each other via a liquid phase during the spheroidizing step.

Due to such heat treatment, as shown in FIG. 4, a part of the flake 13 of boron nitride formed during the first nitriding step reacts with the metal component such as Fe included in the particle 111 and the particle 112 constituting the material powder, then decomposes. As a result, the alloy including much boron will be generated as a different phase from the crystal grain 121 of the soft magnetic metal phase. This alloy exists as the liquid phase, and the liquid phase 141 exists near the surface of the particle 111, further the liquid phase 142 exists near the surface of the particle 112. Further, as shown in FIG. 4, as the liquid phase 141 and the liquid phase 142 contacts, the particle 111 and the particle 112 binds with each other and forms into one particle.

The reaction between a part of the flake of boron nitride and the metal component such as Fe included in the particle is controlled by the condition of the spheroidizing step (the heat treatment temperature, the heat treatment time, and the nitrogen partial pressure or so), hence the binding between the particles with each other caused by the contact between the liquid phase can be controlled by the condition of the spheroidizing step. Due to the binding of the particles, the average particle diameter of the material powder is larger than the average particle diameter of the soft magnetic metal powder of after the spheroidizing step.

Also, the content of boron in each particle constituting the material powder is approximately constant, thus the thickness of the flake of boron nitride formed during the first nitriding step is thinner for the particle having smaller particle diameter. If the flake of boron nitride is thin, then the liquid phase generated during the spheroidizing step easily expose to the outside. As a result, the liquid phases tend to contact with each other. That is, the particles having small particle diameter present at the edge of the particle size distribution preferentially binds with each other, hence the particle size distribution becomes narrow.

Figure 5:
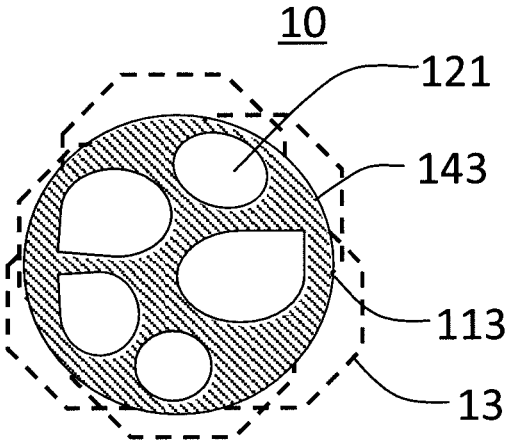
FIG. 5 is the schematic diagram describing the spheroidization of the bound particle during the spheroidizing step.

As shown in FIG. 5, when the particle 111 and the particle 112 are bound, the integrally formed particle 113 is formed. Along with the binding of the particle 111 and the particle 112, the flake 13 of boron nitride covering the surface of the particle 111 and the particle 112 which remained without being decomposed will cover the particle 113. The alloy of the liquid phase present in the particle 113 spheroidizes while holding the crystal grain 121 by surface tension at the inside of the flake of the boron nitride, and the cross section shape of the particle 113 forms a circular shape. The alloy of the liquid phase has very poor wettability with the flake of the boron nitride, thus it does not adhere to the flake of boron nitride and the spheroidization proceeds smoothly.

Also, the flake of boron nitride remaining on the particle surface, and the flake of boron nitride released off from the particle surface when the particles binds or so are present between the other particles, thereby the contact frequency of the liquid phases against each other between the particles is suppressed, hence the coarse particle can be suppressed which is formed as the binding of the particles with each other proceeds too much.

Note that, most part of the remaining boron in the particle and boron derived from the flake 13 of boron nitride exist in the liquid phase 143 of the particle 113. Therefore, if the liquid phase 143 is cooled and solidified, ferromagnetic boron compound such as $Fe_2B$ or so is formed, and exists between the crystal grains 121.

The nitrogen partial pressure in the atmosphere during the spheroidizing step is preferably less than 0.01 atm (for example nitrogen concentration of 1% in the atmospheric pressure). For example, as such atmosphere, argon atmosphere having 100% argon, and mixed atmosphere between argon and nitrogen or so may be mentioned as examples. Also, even under the nitrogen atmosphere, by decreasing the pressure of the atmosphere using the vacuum pump or so to make the nitrogen partial pressure to less than 0.01 atm, the same effect can be exhibited. Also, the oxygen partial pressure in the atmosphere is preferably 0.0001 or less. If the oxygen partial pressure is too high, then the oxidizing reaction of the metal will proceed along with the formation of the alloy, thus the particles tend to bind with each other.

At the spheroidizing step, the heat treatment temperature is preferably 1100° C. or more, and more preferably 1250° C. or more. Also, the heat treatment temperature is preferably 1300° C. or less. If the heat treatment is too low, the produced amount of the liquid phase alloy is little, and the reaction for binding the particles tends not to proceed. On the other hand, if the heat treatment temperature is too high, then the control of the particle diameter of the particle binding via the liquid phase tends to become difficult.

(1.4 Boron Nitride Removal Step)

It is obvious from FIG. 3 and FIG. 5 that the soft magnetic metal powder after the first nitriding step and the spheroidizing step include the flake of boron nitride. In case the dust core is formed using this soft magnetic metal powder, the flake of the boron nitride is present between the soft magnetic metal powders. As the boron nitride is non-magnetic, the relative density of the dust core tends to slightly decrease. Also, the boron nitride present between the soft magnetic metal powders generates a demagnetizing field in the soft magnetic metal powder, and as a result the magnetic permeability tends to decline.

Therefore, in case a high magnetic permeability of the dust core is demanded, the boron nitride removal step is preferably carried out to the soft magnetic metal powder after the spherodizing step.

During the first nitriding step, boron nitride is formed by contacting to the surface of the particle. However, due to the spheroidizing step carried out after the first nitriding step, the binding of the particles, or the deformation of the particle shape occur, thus the flake of boron nitride which has been formed will be released easily.

Such flakes of boron nitride can be separated from the soft magnetic metal particles by a predetermined procedure. If high magnetic permeability is not in demand, using the classification device such as sieving, cyclone, electrostatic separation, magnetic separation, wind power separation, and wet sedimentation method or so, the flakes which are easily released can be mainly separated.

Also, in case the high magnetic permeability is in demand, for example by grinding the soft magnetic metal powder, the flake of boron nitride can be forcibly separated from the soft magnetic metal particle by applying a small impact to the soft magnetic metal particle. For the grinding device, general grinding device such as wet ball mill, dry ball mill, jet mill or so can be used. Also, the multifunction device such as grinding device having classification function may be used.

Note that, even if the boron nitride removal step is carried out, the flake of boron nitride cannot be removed completely, and the soft magnetic metal powder of after the boron nitride removal step still includes boron nitride. Therefore, depending on the desired magnetic characteristic, the boron nitride may be removed by controlling the classification and grinding or so.

Figure 6:
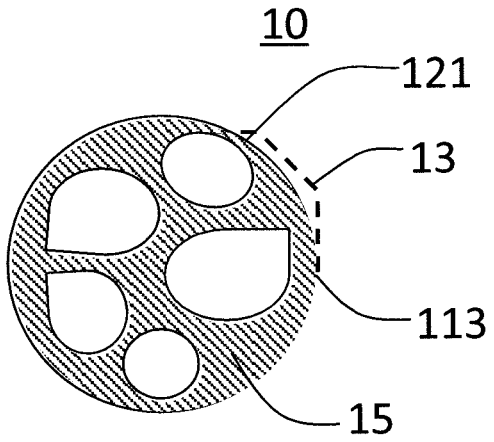
FIG. 6 is the schematic diagram of the cross section of the particle constituting the soft magnetic metal powder after the boron nitride removal step.

FIG. 6 is a schematic diagram of the cross section of the particle constituting the soft magnetic metal powder of after the boron nitride removal step. The thin layer of the boron nitride at the outer side of the surface of the particle 113 is removed by the grinding step and/or the separation step. The removal rate of boron nitride may differ depending on the condition of the grinding step or the condition of the separation step, but it cannot be removed completely, thus at least minute amount of the thin layer 13 of boron nitride remains on the particle surface. Note that, for the particle 113, a secondary phase 15 which is formed by the solidified liquid phase is present between the crystal grains 121.

(1.5 Second Nitriding Step)

The material powder including the soft magnetic metal and boron is subjected to the first nitriding step and the spheroidizing step, thereby the particles bind with each other via the liquid phase and spheroidized integrally.

However, as mentioned in the above, the alloy derived from the liquid phase present between the crystal grains of the particle after the spheroidizing step is a ferromagnetic phase having large crystal magnetic anisotropy such as $Fe_2B$ or so. If such ferromagnetic phase is included in the soft magnetic metal powder, the coercivity of the soft magnetic metal powder tends to increase.

Thus, in the present embodiment, in order to decrease the coercivity, the material powder of after the spheroidizing step is subjected to the second nitriding step.

During the second nitriding step, the material powder after the spheroidizing step is heat treated in non-oxidizing atmosphere including nitrogen. The nitrogen partial pressure in the atmosphere at the second nitriding step is higher than the nitrogen partial pressure in the atmosphere during the spheroidizing step. Due to such heat treatment, the nitrogen in the atmosphere reacts with boron in the ferromagnetic phase constituting the grain boundary, and a coating part including boron nitride is formed at the surface of the particle as similar to the first nitriding step.

Figure 7:
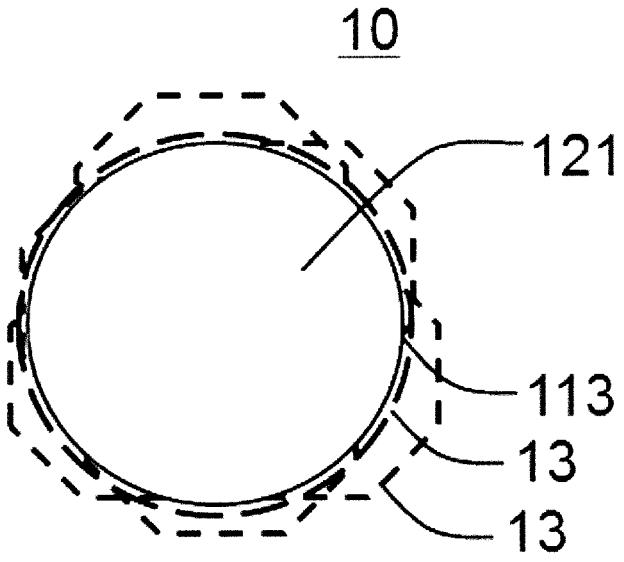
FIG. 7 is the schematic diagram of the cross section of the particle constituting the soft magnetic metal powder after the second nitriding step.

In the present embodiment, this coating part is flake 13 of boron nitride. That is, as shown in FIG. 7, boron remaining on the spheroidized particle 113 is reacted with nitrogen in the atmosphere, and discharged as the flake 13 of boron nitride on the surface of the particle 113; thereby the boron concentration in the particle 113 can be decreased. As a result, the coercivity of the soft magnetic metal powder after the second nitriding step can be decreased.

The cross section shape of the particle 113 is spherical shape. Due to the discharge of boron from the ferromagnetic phase, the crystal grain 121 grows towards the outside, and as shown in FIG. 7, at the end, one particle 113 is constituted from one crystal grain 121. Note that, due to the second nitriding step, most part of boron included in the particle 113 is discharged out of the particle as the flake 13 of boron nitride, but as already mentioned in above minute amount of boron remains inside of the metal particle 113.

The smaller the amount of the boron remains inside the particle, the lower the coercivity is, hence preferably the entire amount of boron is discharged out of the particle. However, as boron included in the particle decreases due to the nitriding reaction, the nitriding reaction becomes difficult to proceed thermodynamically. Therefore, it is extremely difficult to completely discharge the remaining boron in the particle.

Particularly, a certain amount of boron is known to solid dissolve in the metal phase (for example, about 15 ppm at 900° C. for Fe), and the amount of boron in the particle constituted by the soft magnetic metal phase having Fe as the main phase is difficult to be 15 ppm or less. On the other hand, the present inventors have found that if the amount of boron in the particle is 150 ppm or less, the effect to the coercivity is limited. The amount of boron is more preferably 100 ppm or less.

Thus, in the present embodiment, the condition of the second nitriding step is set so that the amount of boron in the particle is 150 ppm or less.

During the second nitriding step, the nitrogen partial pressure in the atmosphere is higher than the nitrogen partial pressure in the atmosphere at the spheroidizing step. Specifically, the nitrogen partial pressure in the atmosphere is preferably 0.01 atm or more, more preferably 0.5 atm or more, further preferably 0.9 atm or more, and even more preferably 1 atm. That is, nitrogen atmosphere is particularly preferable. Also, the oxygen partial pressure in the atmosphere is preferably 0.0001 atm or less. If the oxygen partial pressure is too high, the nitriding reaction proceeds in parallel with the oxidizing reaction of the metal, and the coating part tends to be formed unevenly.

During the second nitriding step, the heat treatment temperature is preferably 800° C. or more, and more preferably 1200° C. or more. Also, the heat treatment temperature is preferably 1350° C. or less.

If the heat treatment temperature is too low, the moving speed of boron atom becomes slow, thus boron in the particle cannot move to the surface, and the nitriding reaction of the boron tends not to proceed. On the other hand, if the heat treatment temperature is too high, boron nitride is heat decomposed, thus the nitriding reaction of boron may be insufficient.

Figure 8:
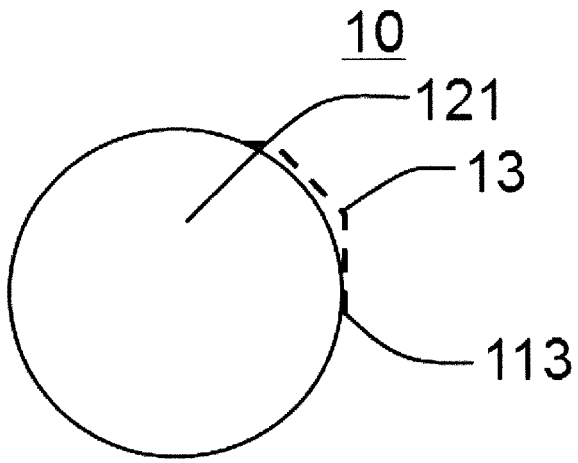
FIG. 8 is the schematic diagram of the cross section of the particle constituting the soft magnetic metal powder carried out with the boron nitride removal step after the second nitriding step.

Note that, after the second nitriding step, the above mentioned boron nitride removal step is carried out. During the second nitriding step, the shape of the particle does not change, thus the flake of boron nitride is kept in contact with the surface of said particle, and is barely released. Thus, in case of carrying out the boron nitride removal step after the second nitriding step, the powder is preferably ground. As shown in FIG. 8, after the boron nitride removal step, one particle 113 is formed of one crystal grain 121, and the cross section shape of the particle 113 is spherical.

2. Soft Magnetic Metal Powder

By carrying out the above mentioned first nitriding step and spheroidizing step, the soft magnetic metal powder including the particle having a true sphere shape or shape close to true sphere can be obtained. "The soft magnetic metal powder including the particle having true sphere shape or shape close to true sphere" refers to the soft magnetic metal powder having average roundness of 0.80 or more wherein the roundness of the cross section of the soft magnetic metal particle constituting the soft magnetic metal powder is calculated and the average value thereof is defined as the average roundness. Particularly, among the soft magnetic metal particle constituting the soft magnetic metal powder, 90% or more of the soft magnetic metal powder has the roundness of 0.80 or more.

The method of measuring the roundness may be done as described in below. First, the obtained soft magnetic metal powder is fixed by embedding into cold mounting resin, then the cross section of the particle constituting the powder is mirror polished to expose. Next, the particle exposed with the cross section is observed by optical microscope and scanning electron microscope (SEM) or so, and the observed image is image processed thereby the roundness of said particle is measured. The numbers of particles being measured are preferably 20 or more, and more preferably 100 or more. Also, as the roundness, the Wadell roundness is preferably used. That is, the diameter of circle equivalent to the imaged area of the particle cross section is evaluated with respect to the diameter of the circumscribed circle at the particle cross section. In case of the complete circle, the Wadell roundness is 1. Therefore, the closer the Wadell roundness is to 1, the closer the particle cross section is to the complete circle.

The above mentioned JP Patent Application Laid Open No. H02-57608 discloses to increase the roundness of the particle of the powder produced using the water atomization method by comprising boron and phosphor. However, the roundness of the particle can be increased by comprising boron, but because the powder is produced by the water atomization method, many particles having irregular shape is inevitably included.

On the other hand, in the present embodiment, instead of using the material powder having improved shape of particle, the material powder is heat treated to improve the shape of the powder. Therefore, even if the shape of the particle is irregular, the particle having a true sphere shape or close to a true sphere shape can be obtained.

Also, by carrying out the above mentioned first nitriding step and spheroidizing step, the soft magnetic metal powder having small standard deviation of the particle size distribution can be obtained. In the present embodiment, the particle size distribution of the soft magnetic metal powder is the particle size distribution obtained from the particle diameter based on the volume which is calculated using a laser diffraction scattering method. Regarding such particle size distribution, the standard deviation can be expressed by below equations 1 to 3.

$$\text{Standard deviation}=(\sigma 1+\sigma 2)/2 \quad \text{Equation 1}$$

$$\sigma 1 = \ln(d50/d16) \quad \text{Equation 2}$$

$$\sigma 2 = \ln(d84/d50) \quad \text{Equation 3}$$

In the above, "d16", "d50", and "d84" show the 16% cumulative particle diameter, 50% cumulative particle diameter, 84% cumulative particle diameter respectively.

By producing the soft magnetic metal powder by carrying out the first nitriding step and the spheroidizing step, the standard deviation of the particle size distribution ($(\sigma 1+\sigma 2)/2$) of said soft magnetic metal powder is 0.50 or less. That is, the particle size distribution becomes sharp. By using such powder having small standard deviation, the dust core having high density and low core loss can be produced. The reason of this is described in below.

In order to produce the dust core having high density, two types or more of the powder having different average particle diameter are mixed and used. When the powder having larger average particle diameter is P1, and the powder having smaller particle diameter is P2, the particle having relatively small particle diameter constituting P2 is placed between the particles having relatively large particle diameter constituting P1. In this case, in order to highly densify the dust core, preferably the ratio P1(d16)/P2(d84) is made large, wherein said ratio is the ratio between 16% cumulative particle diameter of P1 (hereinafter, it will be shown as P1(d16)) and 84% cumulative particle diameter of P2 (hereinafter, it will be shown as P2(d84)).

On the other hand, in order to decrease the core loss of the dust core, the coarse particle included in the powder constituting the core is preferably little. This is because, the larger the particle diameter is, the more the eddy current loss increases. Therefore, if the 50% cumulative diameter of P1 (hereinafter, it will be shown as P1(d50)), which is the powder having larger average particle diameter, is too large, the eddy current loss increases, thus P1(d50) is preferably small.

In order to make P1(d50) small and make P1(d16)/P2(d84) large, the ratio between P1(d50) and P1(d16), that is P1(d50)/P1(d16) needs to be as small as possible.

Also, in order to decrease the coarse particle in the powder constituting the core, the ratio between 84% cumulative diameter of P1 (hereinafter, it will be shown as P1(d84)) and P1(d50) that is P1(d84)/P1(d50) needs to be as small as possible.

As discussed in above, among the powder used for the production of the dust core, as the powder having large average particle diameter, the powder having small standard deviation of the particle size distribution is preferable. Also, as the powder having small average particle diameter, the powder having small standard deviation of the particle size distribution is preferable. Therefore, the soft magnetic metal powder produced by the method according to the present embodiment has small standard deviation of the particle size distribution, thus it is suitable as the powder used for the production of the dust core.

Also, by carrying out the second nitriding step in addition to the first nitriding step and the spheroidizing step, the content of boron in the soft magnetic metal particle constituting the soft magnetic metal powder can be reduced. Specifically, the content of boron in the particle constituting the soft magnetic metal powder is preferably 150 ppm or less, more preferably 100 ppm or less.

In case the phase constituted from the ferromagnetic boron compound is present in the soft magnetic metal particle, the coercivity of the soft magnetic metal powder becomes large. Thus, during the second nitriding step, boron is discharged from the ferromagnetic boron compound and decomposed, thereby the content of boron in the particle is reduced, and the coercivity of the soft magnetic metal powder can be made small.

The content of boron in the particle can be measured by ICP. In case the flake of boron nitride is included in the soft magnetic metal powder, boron of boron nitride is also detected, thus the flake of boron nitride needs to be removed as much as possible by the above mentioned boron nitride removal step or by other method.

Also, by carrying out the boron nitride removal step in addition to the first nitriding step and the spheroidizing step, a non-magnetic component included in the soft magnetic metal powder which does not contribute to a magnetic characteristic such as a magnetic permeability or so can be reduced as well.

3. Modified Example

The first nitriding step, the spheroidizing step, and the second nitriding step may be carried out independently, or these may be carried out continuously. In case of carrying out continuously, when moving to the next step, the atmosphere is changed and the temperature is increased or decreased so that the temperature is at a predetermined heat treatment temperature.

Hereinabove, the embodiment of the present invention has been described, but the present invention is not to be limited thereto, and various modifications may be done within the scope of the present invention.

EXAMPLE

Hereinafter, the present invention is explained in further detail using an example. Note that, the present invention is not to be limited to the below example.

Experiment 1

First, the main composition of the soft magnetic metal was made so to satisfy the composition shown in Table 1, and the content of boron included in the soft magnetic metal to satisfy the value shown in Table 1; thereby the material powder was produced by the water atomization method. The particle size distribution of the produced material powder was the same.

TABLE 1

| | Material powder | | First nitriding step | | Spheroidizing step | | Soft magnetic metal powder | | | |
|---|---|---|---|---|---|---|---|---|---|---|
| | Main composition | Boron [mass %] | Temp. [° C.] | Atmosphere | Temp. [° C.] | Atmosphere | Form | Standard deviation of the particle size distribution | Average particle diameter [μm] | Average roundness |
| Example 1-1 | Fe—6.5%Si | 0.8 | 1300 | Nitrogen | 1300 | Argon | Powder | 0.48 | 85 | 0.91 |
| Comparative example 1-2 | Fe—6.5%Si | 0 | — | — | — | — | Powder | 0.85 | 25 | 0.72 |
| Comparative example 1-3 | Fe—6.5%Si | 0 | 1300 | Nitrogen | — | — | Sintered | — | — | — |
| Comparative example 1-4 | Fe—6.5%Si | 0 | — | — | 1300 | Argon | Sintered | — | — | — |
| Comparative example 1-5 | Fe—6.5%Si | 0.8 | 1300 | Nitrogen | — | — | Powder | 0.81 | 25 | 0.73 |
| Comparative example 1-6 | Fe—6.5%Si | 0.8 | — | — | 1300 | Argon | Sintered | — | — | — |
| Comparative example 1-7 | Fe—6.5%Si | 0.8 | — | — | — | — | Powder | 0.83 | 26 | 0.72 |

The produced material powder was filled in the crucible made of alumina, and placed on a tube furnace, and then each heat treatment shown in Table 1 was carried out. The first nitriding step was carried out under the condition of the heat treatment temperature of 1300° C., the holding time of 5 hours, and the nitrogen atmosphere (100% nitrogen concentration, 1 atm). Also, the spheroidizing step was carried out under the condition of the heat treatment temperature of 1300° C., the holding time of 1 hour, and the argon atmosphere (100% argon concentration, 1 atm). Note that, the material powder of the comparative example 1-2 and the comparative example 1-7 did not have heat treatment.

The embodiment of the material powder of after the heat treatment is shown in Table 1. According to Table 1, the particles included in the powder were sintered with each other after the heat treatment for the material powder of the comparative examples 1-3, 1-4, and 1-6.

For the samples (the example 1-1, the comparative examples 1-2, 1-5 and 1-7) wherein the embodiment of the material powder after the heat treatment is powder, the standard deviation of the particle size distribution, the average particle diameter and the roundness of the particle were measured.

First, using the laser diffraction particle size distribution measurement device HELOS & RODOS (made by Japan Laser Corp.), the particle size distribution of the powder was measured. From the obtained particle size distribution, the standard deviation of the particle size distribution and the average particle diameter were calculated. The results are shown in Table 1.

Next, the powder is fixed in the cold mounting resin, and it was mirror polished so that the cross section of the particle was exposed. The obtained cross section was observed by scanning electron microscope (SEM), and 20 cross sections of the particles were randomly selected to measure the degree of roundness thereof, thereby the average roundness was calculated from the average value thereof. As the roundness, the Wadell roundness was used. The results are shown in Table 1.

Figure 9:
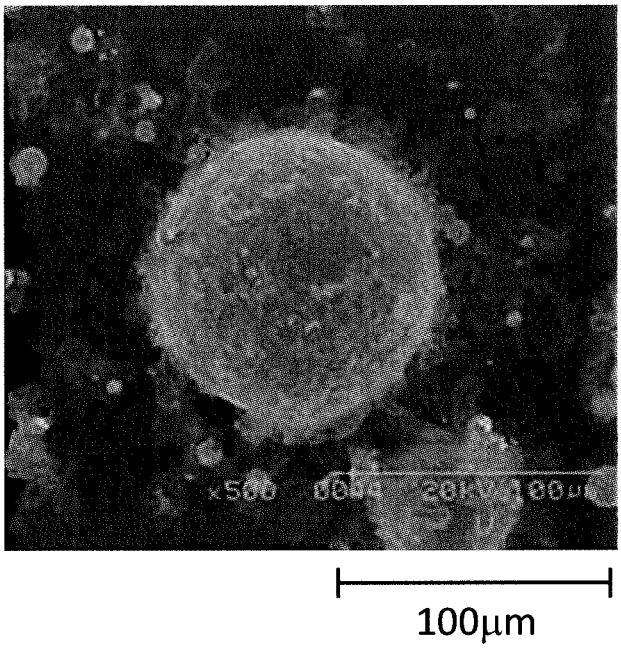
FIG. 9 is a SEM image of the outer appearance of the soft magnetic metal powder according to the example of the present invention.
Figure 10:
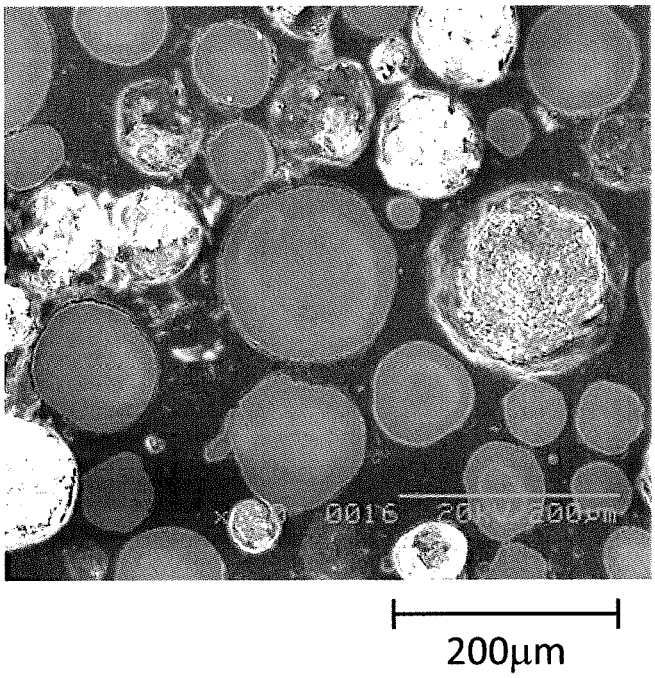
FIG. 10 is a SEM image of the cross section of the soft magnetic metal powder according to the example of the present invention.

Also, FIG. 9 shows the image wherein the outer appearance of the material powder of the example 1-1 observed by SEM, FIG. 10 shows the image of the cross section of the particle observed by SEM. Further, the cross section of the particle of the material powder of the comparative example 1-7 observed by SEM is shown in FIG. 11.

According to Table 1, FIG. 9 and FIG. 10, it was confirmed that by carrying out both the first nitriding step and the spheroidizing step to the material powder including boron, the soft magnetic metal powder having particle with high roundness and having small standard deviation of particle size distribution can be obtained (the example 1-1). Also, the flake of boron nitride on the surface of the particle was confirmed in FIG. 9. FIG. 10 shows a color contrast in the particle, and the part relatively bright at the inner side was crystal grain of FeSi alloy as the soft magnetic metal, and the darker part at the outer side was the secondary phase including much boron.

On the other hand, it was confirmed that if a high temperature heat treatment is carried out such as the first nitriding step and spheroidizing step to the material powder without boron, then the particles included in the powder sinters with each other, and was unable to use as the powder (the comparative examples 1-3 and 1-4). Also, it was confirmed that if only the first nitriding step was carried out to the material powder including boron, then the roundness of the particle was low, and the soft magnetic metal powder had a large standard deviation of the particle size distribution (the comparative example 1-5). Also, it was confirmed that if only the spheroidizing step was carried out to the material powder including boron, then the coating part including boron nitride was not formed to the surface of the particle, and the particles sintered with each other and was unable to use as the powder (the comparative example 1-6).

Figure 11:
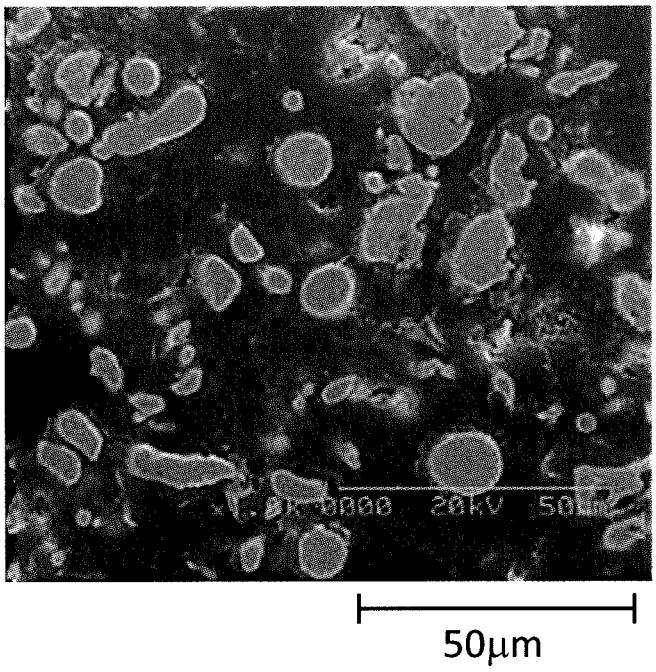
FIG. 11 is a SEM image of the cross section of the material powder.

Also, according to FIG. 11, it was confirmed that regardless of including boron or not, the material powder without the heat treatment ended as the soft magnetic metal powder having low roundness of the particle, and having large standard deviation of the particle size distribution (the comparative examples 1-2 and 1-7).

Experiment 2

Using the same material powder as the example 1-1, the same heat treatment as the example 1-1 was carried out, and then the boron nitride removal step was further carried out. During the boron nitride removal step, the material powder of after the spheroidizing step was placed in a plastic cup, and also acetone was added thereto then stirred. After stirring, the flake of boron nitride floating in acetone was collected using syringe. The same evaluations as the example 1-1 were carried out to the material powder of after the boron nitride removal step. Results are shown in Table 2. Note that, the example 2-2 of Table 2 is the example 1-1 of Table 1.

TABLE 2

| | Material powder | | First nitriding step | | Spheroidizing step | | Boron nitride | Soft magnetic metal powder | | | |
|---|---|---|---|---|---|---|---|---|---|---|---|
| | Main composition | Boron [mass %] | Temp. [° C.] | Atmos-phere | Temp. [° C.] | Atmos-phere | removal step | Form | Standard deviation of the particle size distribution | Average particle diameter [μm] | Average round ness |
| Example 2-1 | Fe—6.5%Si | 0.8 | 1300 | Nitrogen | 1300 | Argon | Carried out | Powder | 0.38 | 90 | 0.91 |
| Example 2-2 | Fe—6.5%Si | 0.8 | 1300 | Nitrogen | 1300 | Argon | — | Powder | 0.48 | 85 | 0.91 |

According to Table 2, it was confirmed that by carrying out the boron nitride removal step, the standard deviation of the particle size distribution can be made even smaller.

Experiment 3

The soft magnetic metal powder was obtained as same as the example 2-1 except for carrying out the second nitriding step under the condition shown in Table 3 after the spheroidizing step, and then carrying out the boron nitride removal step after the second nitriding step. The same evaluations as the experiment 2 were carried out to the obtained soft magnetic metal powder, and the coercivity and the boron amount in the particle were measured.

The coercivity was measured as described in below. 20 mg of the soft magnetic metal powder was placed in the plastic case having a size of ϕ6 mm×5 mm, and paraffin was melted then fixed by solidifying, then this was measured using a coercimeter (K-HC1000 made by TOHOKU STEEL CO., LTD). The measured magnetic field was 150 kA/m. The results are shown in Table 3.

The obtained soft magnetic metal powder was ground by ball mill, and acetone was added thereto and stirred, thereby the thin layer of boron nitride was floated in acetone. The boron nitride was removed by separating and removing the supernatant acetone. The grinding time was changed to 1 hour, 2 hours, 13 hours and 18 hours, then the nitrogen content amount and the boron content amount were measured. The nitrogen content amount was measured by nitrogen amount analyzer (TC600 made by LECCO CORPORATION). The boron amount was measured by ICP. As the grinding time gets longer, the amount of boron nitride decreases, thus the nitrogen content and boron content both decrease, but the boron content in the particle does not change. Thus, the relation between the nitrogen content and the boron content were determined to extrapolate the boron content when the nitrogen content was 0, and said value was defined as the boron amount in the particle. Note that, the quantified lower limit of boron was 10 ppm. The results are shown in Table 3. Note that, the example 3-1 of Table 3 is the example 2-1 of Table 2.

Figure 12:
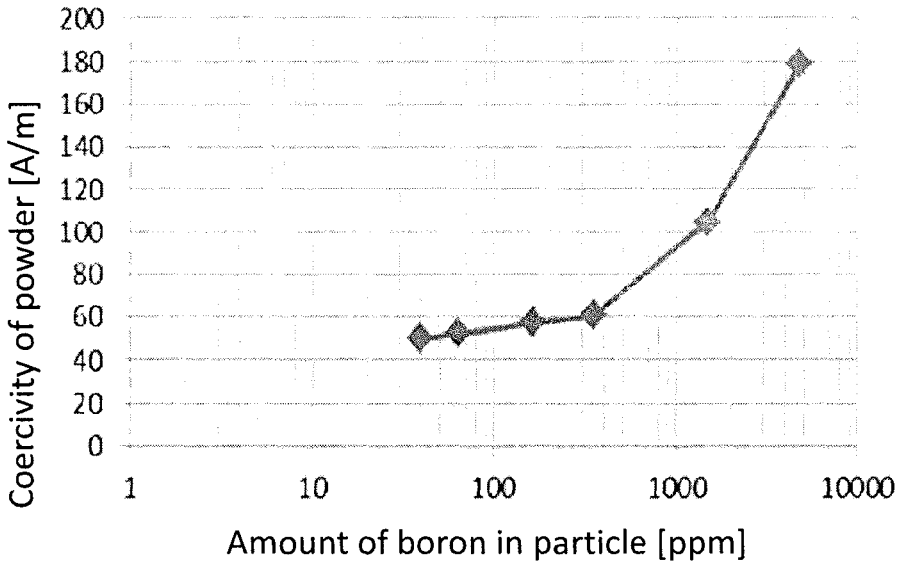
FIG. 12 is a graph showing the relation between the amount of boron in the particle and the coercivity of the powder in the soft magnetic metal powder according to the example of the present invention.

Also, the graph indicating the relation between the boron amount in the particle and the coercivity of the powder is shown in FIG. 12.

TABLE 3

| | Material powder | | First nitriding step | | Spheroidizing step | | Second nitriding step Holding | | |
|---|---|---|---|---|---|---|---|---|---|
| | Main composition | Boron [mass %] | Temp. [° C.] | Atmos-phere | Temp. [° C.] | Atmos-phere | Temp. [° C.] | time [h] | Atmos-phere |
| Example 3-1 | Fe—6.5%Si | 0.8 | 1300 | Nitrogen | 1300 | Argon | — | — | — |
| Example 3-2 | Fe—6.5%Si | 0.8 | 1300 | Nitrogen | 1300 | Argon | 1300 | 0 | Nitrogen |
| Example 3-3 | Fe—6.5%Si | 0.8 | 1300 | Nitrogen | 1300 | Argon | 1300 | 0.5 | Nitrogen |
| Example 3-4 | Fe—6.5%Si | 0.8 | 1300 | Nitrogen | 1300 | Argon | 1300 | 1 | Nitrogen |
| Example 3-5 | Fe—6.5%Si | 0.8 | 1300 | Nitrogen | 1300 | Argon | 1300 | 2 | Nitrogen |
| Example 3-6 | Fe—6.5%Si | 0.8 | 1300 | Nitrogen | 1300 | Argon | 1300 | 5 | Nitrogen |

| | Boron nitride removal step | Soft magnetic metal powder | | | | | |
|---|---|---|---|---|---|---|---|
| | | Form | Standard deviation of the particle size distribution | Average particle diameter [μm] | Average round-ness | Coer-civity [A/m] | Amount of boron in the particle [ppm] |
| Example 3-1 | carried out | Powder | 0.38 | 90 | 0.91 | 179 | 4763 |
| Example 3-2 | carried out | Powder | 0.37 | 90 | 0.91 | 105 | 1490 |
| Example 3-3 | carried out | Powder | 0.37 | 89 | 0.92 | 61 | 351 |
| Example 3-4 | carried out | Powder | 0.38 | 91 | 0.91 | 58 | 163 |

TABLE 3-continued

| | | | | | | | |
|---|---|---|---|---|---|---|---|
| Example 3-5 | carried out | Powder | 0.39 | 90 | 0.90 | 52 | 64 |
| Example 3-6 | carried out | Powder | 0.38 | 90 | 0.91 | 50 | 40 |

According to Table 3 and FIG. 12, it was confirmed that by carrying out the second nitriding step, the boron amount in the particle can be reduced, and as result, the coercivity of the powder can be reduced.

Experiment 4

The material powder was produced by the water atomization method so that the main composition of the soft magnetic metal satisfied the composition shown in Table 4, and the content of boron included in the soft magnetic metal satisfied the value shown in Table 4. The particle size distribution of the produced material powder was same.

The produced material powder was filled in the crucible made of alumina, and placed on the tube furnace, and then each heat treatment shown in Table 4 was carried out. The first nitriding step was carried out under the condition of the heat treatment temperature of 850° C., the holding time of 1 hour, and the nitrogen atmosphere (100% nitrogen atmosphere, 1 atm). The spheroidizing step was carried out under the condition of the heat treatment temperature of 1250° C., the holding time of 1 hour, and the argon atmosphere (100% argon atmosphere, 1 atm). The second nitriding step was carried out under the condition of the heat treatment temperature of 1250° C., the holding time of 1 hour, and the nitrogen atmosphere (100% nitrogen atmosphere, 1 atm).

For the sample including boron, the weight change rate at the first nitriding step was obtained. The weight increase in case FeSiB alloy was heated in nitrogen was caused by the nitriding reaction of boron, thus the weight increase can be considered as the weight of nitrogen reacted with boron. Then, the ratio of the boron amount among the boron in the powder used for the nitriding reaction was calculated. The results are shown in Table 4.

Also, unlike the measuring of the amount of boron in the particle by ICP as in the experiment 3, the boron amount which has not nitrided was estimated from the weight change rate of after the second nitriding step, thereby the amount of boron in the particle was calculated. The results are shown in Table 4. Considering the measurement accuracy of the weight change, when the calculated amount of boron was 100 ppm or less, the boron amount was described as "<100 ppm" in Table 4.

Further, for the obtained soft magnetic metal powder, the coercivity of the powder was measured as similar to the experiment 3. The results are shown in Table 4. Also, as similar to experiment 1, the particle size distribution of the powder and the roundness of the cross section were measured. The results regarding the comparative example 4-1 and the example 4-3 are respectively shown in FIG. 13 and FIG. 14 to FIG. 15.

TABLE 4

| | Matieral powder | | First nitriding step | | | | Spheroidizing step | | Second nitriding step | | Soft magnetic metal powder | | |
|---|---|---|---|---|---|---|---|---|---|---|---|---|---|
| | Main composition | Boron [mass %] | Temp. [° C.] | Atmosphere | Weight change rate [%] | Nitriding rate of boron [%] | Temp. [° C.] | Atmosphere | Temp. [° C.] | Atmosphere | Form | Coercivity [A/m] | Amount of boron in the particle [ppm] |
| Comparative example 4-1 | Fe—6.5%Si | 0 | — | — | — | — | — | — | — | — | Powder | 633 | <10 |
| Example 4-2 | Fe—6.5%Si | 0.5 | 850 | Nitrogen | 0.45 | 69 | 1250 | Argon | 1250 | Nitrogen | Powder | 105 | <100 |
| Example 4-3 | Fe—6.5%Si | 0.8 | 850 | Nitrogen | 0.63 | 60 | 1250 | Argon | 1250 | Nitrogen | Powder | 96 | <100 |
| Example 4-4 | Fe—6.5%Si | 1.2 | 850 | Nitrogen | 0.64 | 41 | 1250 | Argon | 1250 | Nitrogen | Powder | 88 | <100 |
| Example 4-5 | Fe—6.5%Si | 1.5 | 850 | Nitrogen | 0.62 | 32 | 1250 | Argon | 1250 | Nitrogen | Powder | 92 | <100 |
| Example 4-6 | Fe—6.5%Si | 1.8 | 850 | Nitrogen | 0.60 | 26 | 1250 | Argon | 1250 | Nitrogen | Powder | 279 | 1800 |

According to Table 4, it was confirmed that by using the material powder including boron, and carrying out the first nitriding step, the spheroidizing step and the second nitriding step, the boron amount in the particle can be reduced, and as a result the coercivity of the powder can be reduced.

Figure 13:
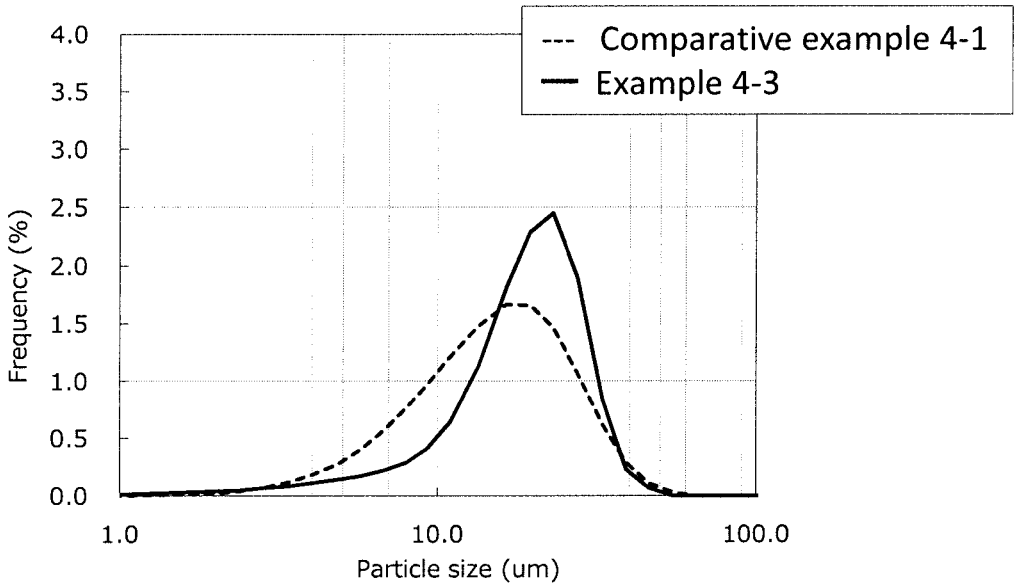
FIG. 13 is a graph showing the particle size distribution of the soft magnetic metal powder according to the example and the comparative example of the present invention.

According to FIG. 13, it was confirmed that the comparative example 4-1 had wide distribution of the particle size (the standard deviation 0.57), on the other hand in the example 4-3, by carrying out the first nitriding step, the spheroidizing step and the second nitriding step, the frequency of the particle having small particle diameter decreased, and the distribution of the particle size was narrowed (the standard deviation of 0.43).

Figure 14:
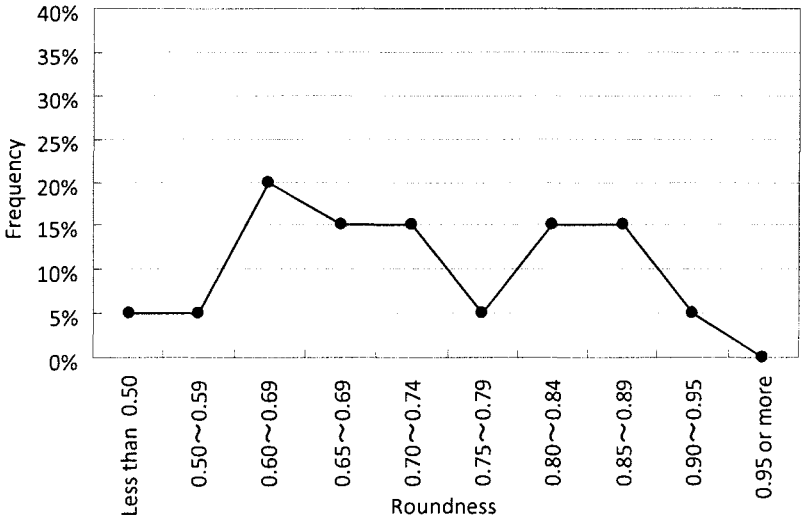
FIG. 14 is the graph showing the distribution of the roundness of the cross section of the material powder.
Figure 15:
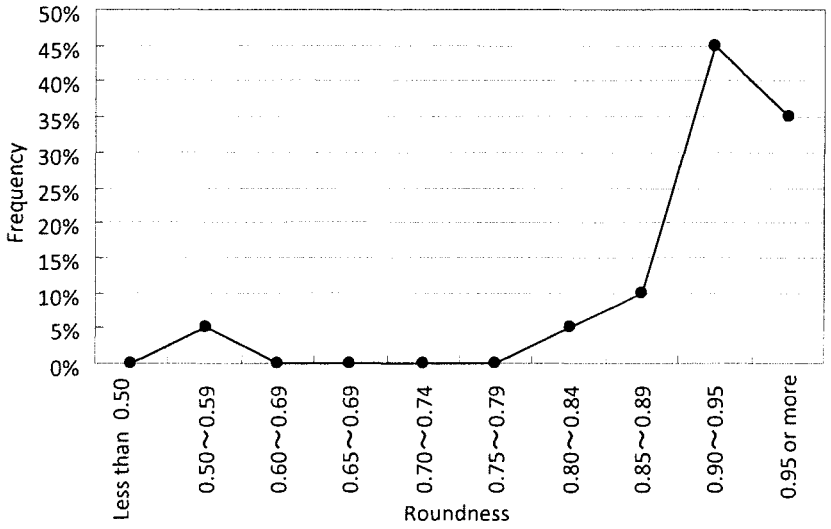
FIG. 15 is the graph showing the distribution of the roundness of the cross section of the soft magnetic metal powder according to the example of the present invention.

According to FIG. 14, the comparative example 4-1 includes many particles with low roundness (the average roundness of 0.73). According to FIG. 15, by carrying out the first nitriding step, the spheroidizing step and the second nitriding step, the example 4-3 shows that the particle with low degree of roundness had decreased, and the degree of roundness of the powder increased (the average roundness of 0.91).

Experiment 5

The material powder was produced by the water atomization method so that the main composition of the soft magnetic metal satisfied the composition shown in Table 5, and the content of boron included in the soft magnetic metal satisfied the value shown in Table 5. The obtained material powder was sieved, thereby the material powder having the average particle diameter of 15 μm, and the average particle diameter of 55 μm were produced.

The produced material powder was filled in the crucible made of alumina, and placed on the tube furnace, and then each heat treatment shown in Table 5 was carried out. The first nitriding step was carried out under the condition of the heat treatment temperature shown in FIG. 5, the holding time of 1 hour, and the nitrogen atmosphere (100% nitrogen atmosphere, 1 atm). The spheroidizing step was carried out under the condition of the heat treatment temperature of 1250° C., the holding time of 1 hour, and the argon atmosphere (100% argon atmosphere, 1 atm). The second nitriding step was carried out under the condition of the heat treatment temperature of 1250° C., the holding time of 1 hour, and the nitrogen atmosphere (100% nitrogen atmosphere, 1 atm).

As similar to the experiment 4, the weight change rate and the nitriding rate at the first nitriding step were determined. Also, as similar to the experiment 4, for the obtained soft magnetic metal powder, the amount of boron in the particle was calculated from the weight change in the second nitriding step. Also, as similar to the experiment 3, the coercivity of the powder was measured. The results are shown in Table 5.

TABLE 5

| | Matieral powder | | | First nitriding step | | | | Spheroidizing step | | Second nitriding step | | Soft magnetic metal powder | | |
|---|---|---|---|---|---|---|---|---|---|---|---|---|---|---|
| | Main composition | Boron [mass %] | Average particle diameter [μm] | Temp. [° C.] | Atmosphere | Weight change rate [%] | Nitriding rate of boron [%] | Temp. [° C.] | Atmosphere | Temp. [° C.] | Atmosphere | Form | Coercivity [A/m] | Amount of boron in the particle [ppm] |
| Example 5-1 | Fe—6.5%Si | 0.8 | 15 | 750 | Nitrogen | 0.21 | 21 | 1200 | Argon | 1250 | Nitrogen | Powder | 150 | <100 |
| Example 5-2 | Fe—6.5%Si | 0.8 | 15 | 800 | Nitrogen | 0.32 | 31 | 1250 | Argon | 1250 | Nitrogen | Powder | 77 | <100 |
| Example 5-3 | Fe—6.5%Si | 0.8 | 15 | 850 | Nitrogen | 0.63 | 60 | 1250 | Argon | 1250 | Nitrogen | Powder | 96 | <100 |
| Example 5-4 | Fe—6.5%Si | 0.8 | 15 | 900 | Nitrogen | 0.96 | 91 | 1250 | Argon | 1250 | Nitrogen | Powder | 151 | <100 |
| Example 5-5 | Fe—6.5%Si | 0.8 | 15 | 1100 | Nitrogen | 1.02 | 98 | 1250 | Argon | 1250 | Nitrogen | Powder | 183 | <100 |
| Example 5-6 | Fe—6.5%Si | 0.8 | 55 | 900 | Nitrogen | 0.37 | 35 | 1250 | Argon | 1250 | Nitrogen | Powder | 80 | <100 |
| Example 5-7 | Fe—6.5%Si | 0.8 | 55 | 1100 | Nitrogen | 0.70 | 67 | 1250 | Argon | 1250 | Nitrogen | Powder | 127 | <100 |

According to Table 5, even if the average particle diameter of the material powder and the heat treatment temperature at the first nitriding step were changed, the same effects were confirmed.

Experiment 6

The material powder was produced by the water atomization method so that the main composition of the soft magnetic metal satisfied the composition shown in Table 6, and the content of boron included in the soft magnetic metal satisfied the value shown in Table 6. The particle size distribution of the produced material powder was same.

The produced material powder was filled in the crucible made of alumina, and placed on the tube furnace, and then each heat treatment shown in Table 6 was carried out. The first nitriding step was carried out under the condition of the heat treatment temperature of 1300° C., the holding time of 5 hours, and the nitrogen atmosphere (100% nitrogen atmosphere, 1 atm). The spheroidizing step was carried out under the condition of the heat treatment temperature of 1300° C., the holding time of 1 hour, and the argon atmosphere (100% argon atmosphere, 1 atm). The second nitriding step was carried out under the condition of the heat treatment temperature of 1300° C., the holding time of 5 hours, and the nitrogen atmosphere (100% nitrogen atmosphere, 1 atm). After the second nitriding step, the boron nitride removal step was carried out as similar to the experiment 2.

For the obtained soft magnetic metal powder, the same evaluations as the experiment 3 were carried out. The results are shown in Table 6.

TABLE 6

| | Material powder | | First nitriding step | | Spheroidizing step | | Second nitriding step | |
|---|---|---|---|---|---|---|---|---|
| | Main composition | Boron [mass %] | Temp. [° C.] | Atmosphere | Temp. [° C.] | Atmosphere | Temp. [° C.] | Atmosphere |
| Example 6-1 | Fe—3Si | 1.2 | 1300 | Nitrogen | 1300 | Argon | 1300 | Nitrogen |
| Example 6 2 | Fe—4.5Si | 1 | 1300 | Nitrogen | 1300 | Argon | 1300 | Nitrogen |

TABLE 6-continued

| | | | | | | | | |
|---|---|---|---|---|---|---|---|---|
| Example 6-3 | Fe—4.5Si—1.9Cr | 1 | 1300 | Nitrogen | 1300 | Argon | 1300 | Nitrogen |
| Example 6-4 | Fe—6.5Si—5.0Cr | 0.8 | 1300 | Nitrogen | 1300 | Argon | 1300 | Nitrogen |
| Example 6-5 | Fe—45Ni | 0.8 | 1200 | Nitrogen | 1250 | Argon | 1300 | Nitrogen |

| | | Soft magnetic metal powder | | | | | |
|---|---|---|---|---|---|---|---|
| | Boron nitride removal step | Form | Standard deviation of the particle size distribution | Average particle diameter [μm] | Average roundness | Coercivity [A/m] | Amount of boron in the particle [ppm] |
| Example 6-1 | Carried out | Powder | 0.39 | 89 | 0.88 | 158 | 40 |
| Example 6 2 | Carried out | Powder | 0.38 | 87 | 0.89 | 195 | 39 |
| Example 6-3 | Carried out | Powder | 0.37 | 90 | 0.90 | 175 | 41 |
| Example 6-4 | Carried out | Powder | 0.35 | 91 | 0.92 | 119 | 40 |
| Example 6-5 | Carried out | Powder | 0.43 | 47 | 0.92 | 65 | 38 |

According to Table 6, it was confirmed that even if the composition and the boron amount of the soft magnetic metal were changed, by carrying out the first nitriding step, the spheroidizing step, and the second nitriding step, the soft magnetic metal powder having high roundness of the particle and small standard deviation of the particle size distribution can be obtained. It was also confirmed that the boron amount in the particle of these soft magnetic metal powder can be reduced, and as a result, the coercivity of the powder can be reduced.

Experiment 7

In the experiment 7, the yield of the soft magnetic metal powder of the examples 3-1 and 3-6 of the experiment 3 were calculated. The yield was calculated as the ratio of the weight of the obtained soft magnetic metal powder with respect to the weight of the ingot used for producing the material powder by the water atomization method. The results are shown in Table 7. Note that, in Table 7, the example 3-1 is the example 7-1, and the example 3-2 is the example 7-2.

Also, the material powder was produced by the water atomization method or by the gas atomization method so that the main composition of the soft magnetic metal satisfied the composition shown in Table 7 and does not include boron. For the produced material powder, the same evaluations as in the experiment 3 were carried out and the yield was calculated. Also, to the produced material powder, the classification by sieving was carried out so that the standard deviation of the particle size distribution and the average particle diameter were as same as the examples 7-1 and 7-2. The results are shown in Table 7.

TABLE 7

| | Material powder | | | First nitriding step | | Spheroidizing step | | Second nitriding step | |
|---|---|---|---|---|---|---|---|---|---|
| | Main composition | Boron [mass %] | Production method | Temp. [° C.] | Atmosphere | Temp. [° C.] | Atmosphere | Temp. [° C.] | Atmosphere |
| Example 7-1 | Fe—6.5%Si | 0.8 | Water atomization method | 1300 | Nitrogen | 1300 | Argon | — | — |
| Example 7-2 | Fe—6.5%Si | 0.8 | Water atomization method | 1300 | Nitrogen | 1300 | Argon | 1300 | Nitrogen |
| Comparative example 7-3 | Fe—6.5%Si | 0 | Water atomization method | — | — | — | — | — | — |
| Comparative example 7-4 | Fe—6.5%Si | 0 | Gas atomization method | — | — | — | — | — | — |
| Comparative example 7-5 | Fe—6.5%Si | 0 | Water atomization method | — | — | — | — | — | — |
| Comparative example 7-6 | Fe—6.5%Si | 0 | Gas atomization method | — | — | — | — | — | — |

| | Soft magnetic metal powder | | | | | | | |
|---|---|---|---|---|---|---|---|---|
| | Boron nitride removal step | Form | Standard deviation of the particle size distribution | Average particle diameter [μm] | Average roundness | Coercivity [A/m] | Amount of boron in the particle [ppm] | yield [%] |
| Example 7-1 | Carried out | Powder | 0.38 | 90 | 0.91 | 179 | 4763 | 95 |
| Example 7-2 | Carried out | Powder | 0.38 | 89 | 0.91 | 48 | 40 | 94 |
| Comparative example 7-3 | — | — | 0.85 | 80 | 0.72 | 342 | <10 | 96 |
| Comparative example 7-4 | — | — | 0.81 | 101 | 0.89 | 167 | <10 | 60 |

TABLE 7-continued

| | | | | | | | | |
|---|---|---|---|---|---|---|---|---|
| Comparative example 7-5 | — | — | 0.38 | 90 | 0.70 | 333 | <10 | 80 |
| Comparative example 7-6 | — | — | 0.38 | 90 | 0.90 | 176 | <10 | 45 |

According to Table 7, it was confirmed that the standard deviation of the particle size distribution and the average roundness of the material powder which did not carry out the steps of the present invention had poorer results compared to the standard deviation of the particle size distribution and the average roundness of the material powder which did carry out the step of the present invention. Also, in case the classification was carried out so that the standard deviation of the particle size distribution of the material powder which did not carry out the steps of the present invention was same as the standard deviation of the particle size distribution of the material powder which did carry out the steps of the present invention, then the yield was extremely low.

The example 7-2 included more boron than the comparative example 7-5 and the comparative example 7-6, nonetheless the soft magnetic metal powder having low coercivity can be obtained by going through the first nitriding step, the spheroidizing step, and the second nitriding step.

Experiment 8

The material powder was produced by the water atomization method so that the main composition of the soft magnetic metal satisfied the composition shown in Table 8, and the content of boron included in the soft magnetic metal satisfied the value shown in Table 8. The particle size distribution of the produced material powder was same.

The produced material powder was filled in the crucible made of alumina, and placed on the tube furnace, and then each heat treatment shown in Table 8 was carried out. The first nitriding step was carried out under the condition of the heat treatment temperature of 1300° C., the holding time of 5 hours, and the nitrogen atmosphere (100% nitrogen atmosphere, 1 atm). The spheroidizing step was carried out under the condition of the heat treatment temperature of 1300° C., the holding time of 1 hour, and the argon atmosphere (100% argon atmosphere, 1 atm). The second nitriding step was carried out under the condition of the heat treatment temperature of 1300° C., the holding time of 5 hours, and the nitrogen atmosphere (100% nitrogen atmosphere, 1 atm).

After the second nitriding step, the boron nitride removal step as similar to the second experiment 2 was carried out.

For the obtained soft magnetic metal powder, the coercivity was measured as same as the experiment 3. The results are shown in Table 8.

Further, using the obtained soft magnetic metal powder, the dust core was produced. With respect to 100 parts by mass of the soft magnetic metal powder, 2.4 parts by mass of silicone resin was added, and kneaded, then granulated by filtering with 355 μm mesh. Then, this was filled in the metal mold of toroidal shape having the outer diameter of 17.5 mm, and the inner diameter of 11.0 mm; then a molding pressure of 780 MPa was applied to obtain the molded article. The core weight was 5 g. The obtained molded article was heat treated with belt furnace at 750° C. under the nitrogen atmosphere; thereby the soft magnetic metal dust core was obtained.

The magnetic permeability and the core loss of the obtained soft magnetic metal dust core were evaluated. The magnetic permeability was measured using LCR meter (4284A made by Agilent) at the frequency of 1 kHz. The core loss was measured using BH analyzer (SY-8258 made by IWATSU ELECTRIC CO., LTD.) at the frequency of 20 kHz and the measuring magnetic flux density of 50 mT. The results are shown in Table 8.

TABLE 8

| | Material powder | | | First nitriding step | | Spheroidizing step | |
|---|---|---|---|---|---|---|---|
| | Main composition | Boron [mass % | Average particle diameter [μm] | Temp. [° C.] | Atmosphere | Temp. [° C.] | Atmosphere |
| Example 8-1 | Fe—6.5%Si | 0.8 | 15 | 850 | Nitrogen | 1200 | Argon |
| Example 8-2 | Fe—6.5%Si | 0.8 | 15 | 850 | Nitrogen | 1250 | Argon |
| Example 8-3 | Fe—6.5%Si | 0.8 | 15 | 850 | Nitrogen | 1250 | Argon |
| Comapratve example 8-4 | Fe—6.5%Si | 0 | 15 | — | — | — | — |
| Comapratve example 8-5 | Fe—6.5%Si | 0 | 15 | 850 | Nitrogen | — | — |

| | Second nitriding step | | Boron nitride removal step | | Soft magnetic metal powder | | Dust core | |
|---|---|---|---|---|---|---|---|---|
| | Temp. [° C.] | Atmosphere | Grinding | Separator | Form | Coercivity [A/m] | Magnetic permiablity μ at 1 kHz | Core loss 20 kHz, 50 mT [kW/m$^3$] |
| Example 8-1 | 1250 | Nitrogen | None | None | Powder | 96 | 28 | 40 |
| Example 8-2 | 1250 | Nitrogen | None | carried out | Powder | 96 | 46 | 43 |
| Example 8-3 | 1250 | Nitrogen | carried out | carried out | Powder | 96 | 103 | 50 |

TABLE 8-continued

| | | | | | | | | |
|---|---|---|---|---|---|---|---|---|
| Comapratve example 8-4 | — | — | — | — | Powder | 633 | 126 | 66 |
| Comapratve example 8-5 | — | — | — | — | Powder | 365 | 101 | 65 |

According to Table 8, it was confirmed that the dust core produced using the soft magnetic metal powder obtained by carrying out the steps of the present invention had better core loss than that of the dust core produced using the soft magnetic metal powder obtained by not carrying out the steps of the present invention.

What is claimed is:

1. A method of producing a soft magnetic metal powder comprising:

a material powder preparation step of preparing a material powder comprising particles that include boron and a soft magnetic metal including iron, a first nitriding step of nitriding the boron included in said particles by carrying out a heat treatment on said material powder under a non-oxidizing atmosphere including nitrogen, a spheroidizing step of spheroidizing said particles to obtain spheroidized particles by carrying out a heat treatment on said material powder after said first nitriding step under a non-oxidizing atmosphere having lower nitrogen partial pressure than a nitrogen partial pressure of the non-oxidizing atmosphere during said first nitriding step, and a second nitriding step of nitriding the boron included in said spheroidized particles by carrying out a heat treatment on the material powder comprising said spheroidized particles under a non-oxidizing atmosphere having higher nitrogen partial pressure than the nitrogen partial pressure of the non-oxidizing atmosphere during said spheroidizing step, wherein a temperature of the heat treatment during said second nitriding step is within a range from 1200° C. to 1350° C.

2. The method of producing the soft magnetic metal powder as set forth in claim 1 further comprising a boron nitride removal step of removing a part of the boron nitride included in said spheroidized particles.

3. The method of producing the soft magnetic metal powder as set forth in claim 1, wherein a coating including boron nitride is formed on surfaces of said particles during said first nitriding step.

4. The method of producing the soft magnetic metal powder as set forth in claim 1, wherein a coating including boron nitride is formed on surfaces of said spheroidized particles during said second nitriding step.

5. The method of producing the soft magnetic metal powder as set forth in claim 1, wherein a content of said boron included in the material powder is within a range from 0.4 mass % to 2.0 mass % during said material powder preparation step.

6. The method of producing the soft magnetic metal powder as set forth in claim 1, wherein said soft magnetic metal is crystalline.

7. The method of producing the soft magnetic metal powder as set forth in claim 1, wherein said material powder is contained in a container during said first nitriding step and said spheroidizing step.

8. The method of producing the soft magnetic metal powder as set forth in claim 1, wherein said material powder is contained in a crucible during said first nitriding step and said spheroidizing step.

9. The method of producing the soft magnetic metal powder as set forth in claim 1, wherein 90% or more of said spheroidized particles have a roundness of 0.80 or more and the method is performed without classifying said spheroidized particles.

10. The method of producing the soft magnetic metal powder as set forth in claim 1, wherein a temperature of the heat treatment during said spheroidizing step is within a range from 1100° C. to 1300° C.

11. The method of producing the soft magnetic metal powder as set forth in claim 1, wherein the non-oxidizing atmosphere during said spheroidizing step has an oxygen partial pressure of 0.0001 atm or less.

12. The method of producing the soft magnetic metal powder as set forth in claim 1, wherein the non-oxidizing atmosphere during said spheroidizing step is an argon atmosphere having 100% argon or a mixed atmosphere of argon and nitrogen with a nitrogen partial pressure of less than 0.01 atm.

* * * * *